US007610902B2

(12) United States Patent
Beardmore et al.

(10) Patent No.: US 7,610,902 B2
(45) Date of Patent: Nov. 3, 2009

(54) LOW NOISE FUEL INJECTION PUMP

(75) Inventors: John M. Beardmore, Howell, MI (US); Thomas V. Timmons, Brighton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 75 days.

(21) Appl. No.: 11/952,265

(22) Filed: Dec. 7, 2007

(65) Prior Publication Data

US 2009/0065292 A1 Mar. 12, 2009

Related U.S. Application Data

(60) Provisional application No. 60/970,573, filed on Sep. 7, 2007.

(51) Int. Cl.
*F02M 59/46* (2006.01)
*F04B 11/00* (2006.01)

(52) U.S. Cl. ..... 123/467; 417/540

(58) Field of Classification Search ..... 123/467, 123/506; 417/540, 541; 74/569; 251/48–54
See application file for complete search history.

(56) References Cited

U.S. PATENT DOCUMENTS 2,853,947 A * 9/1958 Fraser ..... 417/462
3,592,568 A * 7/1971 Fenne ..... 417/430
4,029,071 A * 6/1977 Saito et al. ..... 123/447
4,074,668 A * 2/1978 Indra ..... 417/242
4,141,329 A * 2/1979 Pompei ..... 123/537
4,161,161 A * 7/1979 Bastenhof ..... 123/447
4,476,835 A * 10/1984 Laufer ..... 123/467
4,591,321 A * 5/1986 Devaux ..... 417/499
4,624,231 A * 11/1986 Fenne ..... 123/450
4,979,674 A * 12/1990 Taira et al. ..... 239/90
5,096,400 A * 3/1992 Budecker et al. ..... 417/540
5,174,334 A * 12/1992 Nogle ..... 137/596.17
5,257,606 A * 11/1993 Willman et al. ..... 123/447
5,372,114 A * 12/1994 Gant et al. ..... 123/502
5,375,576 A * 12/1994 Ausman et al. ..... 123/446
5,390,642 A * 2/1995 Thoma ..... 123/508
5,540,207 A * 7/1996 Absenger ..... 123/508
5,564,395 A * 10/1996 Moser et al. ..... 123/509
6,135,093 A * 10/2000 Kikuchi et al. ..... 123/467
6,439,204 B1 * 8/2002 Duquette ..... 123/506
6,619,186 B2 * 9/2003 Duquette et al. ..... 92/60.5
6,626,148 B1 * 9/2003 Cooke et al. ..... 123/447
6,763,808 B2 * 7/2004 Ryuzaki ..... 123/446
7,066,151 B1 * 6/2006 Bos ..... 123/467
7,165,534 B2 * 1/2007 Usui et al. ..... 123/467
7,353,805 B2 * 4/2008 Spoolstra ..... 123/446
2009/0068041 A1 * 3/2009 Beardmore ..... 417/540

* cited by examiner

*Primary Examiner*—Thomas N Moulis
(74) *Attorney, Agent, or Firm*—Quinn Law Group, PLLC.

(57) ABSTRACT

A fuel pump assembly has a bushing defining a pumping chamber, a plunger, a cam follower piece, and a compliance device for absorbing noise by increasing either or both of a hydraulic and/or a mechanical compliance of the fuel pump assembly. The compliance device may includes a spring washer or a press-fit spring. The pump bushing and/or plunger may include a cavity as the compliance device for increasing dead volume, the cavity being in fluid communication with the pumping chamber via an orifice. A deflectable or movable mechanism is positioned within a cavity for increasing dead volume, and a solenoid varies a diameter of the orifice. The moveable mechanism includes a poppet valve having a switching pressure related to engine speed. A vehicle includes an engine, transmission, fuel rail, and a fuel pump assembly configured with at least one compliance device for absorbing a hydraulic noise component.

15 Claims, 6 Drawing Sheets

LOW NOISE FUEL INJECTION PUMP

CLAIM OF PRIORITY

This application claims priority to U.S. Provisional Application No. 60/970,573 filed on Sep. 7, 2007, which is hereby incorporated by reference in its entirety.

TECHNICAL FIELD

The present invention relates to a direct high-pressure pump assembly having an increased level of hydraulic and/or mechanical compliance for minimizing a hydraulic noise component during a pressurization stroke of the high-pressure pump assembly.

BACKGROUND OF THE INVENTION

A fuel pump is used to move an amount of fuel from a fuel source to a fuel delivery system of an internal combustion engine. Depending on the type of fuel delivery system, such as a carburetor, throttle body injection system, port injection system, or direct fuel injection system, the fuel may be delivered at a relatively low- or high-pressure level. For example, a fuel injection system typically requires the fuel to be delivered at a higher pressure than does a carburetor.

Spark Ignition Direct Injection (SIDI) engines typically employ a high-pressure fuel pump that is driven by a camshaft used for valve train actuation of the internal combustion engine. It is beneficial to drive the fuel pump with the camshaft or a camshaft drive mechanism since certain aspects of pump operation may need to be synchronized with the engine.

Potential benefits of SIDI include a substantial increase in engine power, improved fuel economy, smoother starting, and reduced tailpipe emissions. However, as the higher pressure fuel injection pump systems used with SIDI engines typically employ rail pressures of approximately 150 to 200 bar, the performance of such assemblies may be less than optimal under certain conditions, particularly during periods when the engine is running at a relatively low speed.

SUMMARY OF THE INVENTION

Accordingly, a fuel pump assembly is provided having a pump bushing defining a pumping chamber, a plunger that is moveable within the pumping chamber for pressurizing an amount of fuel, and a cam follower piece that is in continuous contact with the plunger and a moveable engine component. Motion of the engine component moves the cam follower piece and the plunger to pressurize the fuel during a pressurization stroke of the plunger. The pump assembly includes at least one device for absorbing or dissipating a hydraulic noise component along the primary axis of the plunger.

In another aspect of the invention, the device is a spring providing a predetermined spring force along the primary axis of the plunger.

In another aspect of the invention, the spring is positioned at least partially within the cam follower piece, and is a spring washer or a press-fit spring device.

In another aspect of the invention, at least one of the pump bushing and the plunger includes a cavity for increasing a dead volume within the pump bushing, the cavity being in fluid communication with the pumping chamber via a control orifice.

In another aspect of the invention, a solenoid device selectively varies a diameter of a control orifice between the pumping chamber and the cavity.

In another aspect of the invention, a moveable mechanism is positioned within the cavity, with the moveable mechanism being operable for moving in one direction to increase the dead volume, and in the other direction to decrease the dead volume.

In another aspect of the invention, the cavity is positioned within the plunger, and the moveable mechanism includes a valve for selectively admitting fluid into the cavity in response to a predetermined condition.

In another aspect of the invention, the valve is a poppet valve having a calibrated switching pressure that switches the poppet valve at a corresponding threshold engine speed.

In another aspect of the invention, a high-pressure fuel pump assembly includes a pump bushing, a plunger, and a cam follower piece having a cavity formed in one end. The cam follower piece is in continuous dynamic contact at another end with a moveable engine component. The pump bushing, plunger, and/or cam follower cavity includes a device for absorbing a hydraulic noise component along a common axis of the pump bushing and the plunger.

In another aspect of the invention, a vehicle includes an internal combustion engine, a transmission, a fuel rail having at least one fuel injector device configured for injecting an amount of pressurized fuel into the engine, and a fuel pump assembly. The fuel pump assembly has a pumping chamber and a plunger that is moveable within the pumping chamber for pressurizing an amount of fuel, and is configured with at least one device configured for absorbing or dissipating a hydraulic noise component.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
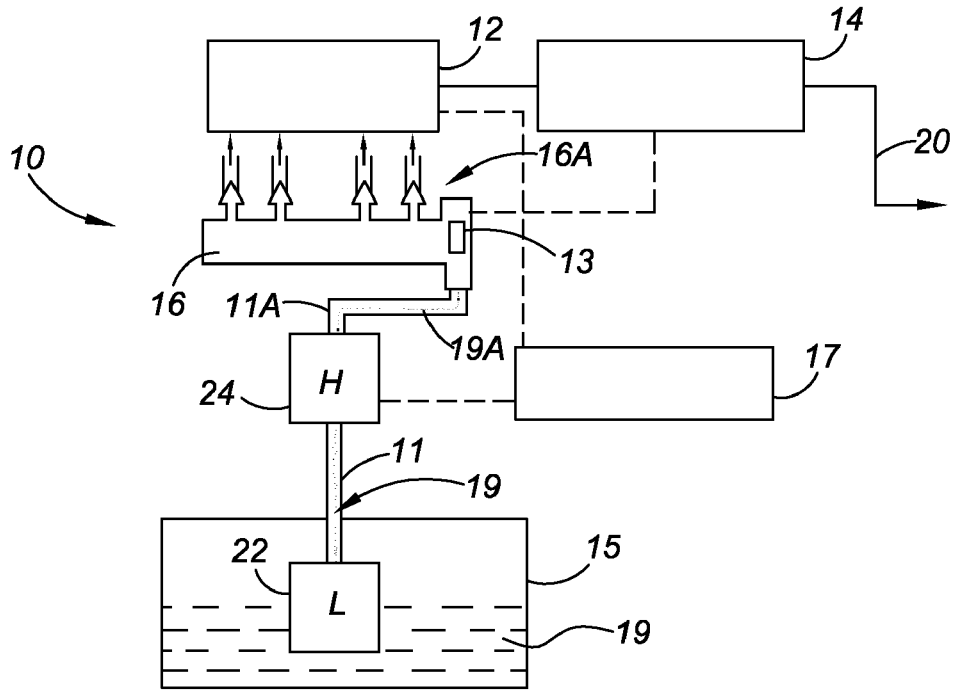
FIG. 1 is a schematic illustration of a vehicle having a combustion engine and a high-pressure (HP) fuel pump assembly according to the invention.

Referring to the drawings, wherein like reference numbers correspond to like or similar components throughout the several figures, and beginning with FIG. 1, a vehicle 10 has an engine 12 that is operatively connected to a transmission 14. The transmission 14 has an output member 20 in driving connection with a plurality of wheels (not shown) for transferring torque or power from the engine 12 to the wheels (not shown) in order to propel the vehicle 10. In one embodiment, the engine 12 is a Spark Ignition Direct Injection (SIDI) engine, however engine 12 may also be a diesel engine or another style or design of engine utilizing high-pressure fuel injection, the operation of which is known to those skilled in the art.

The vehicle 10 includes a low pressure fuel reservoir or tank 15 containing a combustible supply of fuel 19, for example gasoline or diesel fuel. A low-pressure supply pump 22, also labeled "L" in FIG. 1 to represent low pressure, is positioned within the tank 15, and is operable for moving an amount of the fuel 19 through a fuel line 11 to a high-pressure (HP) pump assembly 24 of the invention. The HP pump assembly 24 is operable for rapidly pressurizing the fuel 19 to approximately 150 to 200 bar in one embodiment, however the HP pump assembly 24 may be configured for pressurizing the fuel 19 to any pressure level required by the particular design of the engine 12.

The pressurized fuel 19A is then delivered through a high-pressure fuel line 11A to a fuel rail 16 having at least one pressure sensor 13 adapted for sensing a fluid pressure at or in proximity to the fuel rail 16. From the fuel rail 16, the pressurized fuel 19A is then directly injected into the engine 12 by a series of fuel injectors 16A. An electronic control unit or controller 17 is in electrical communication with the engine 12, the fuel rail 16, the supply pump 22, and the HP pump assembly 24, and provides the necessary control and/or synchronization of the various components of the HP pump assembly 24.

Figure 2A:
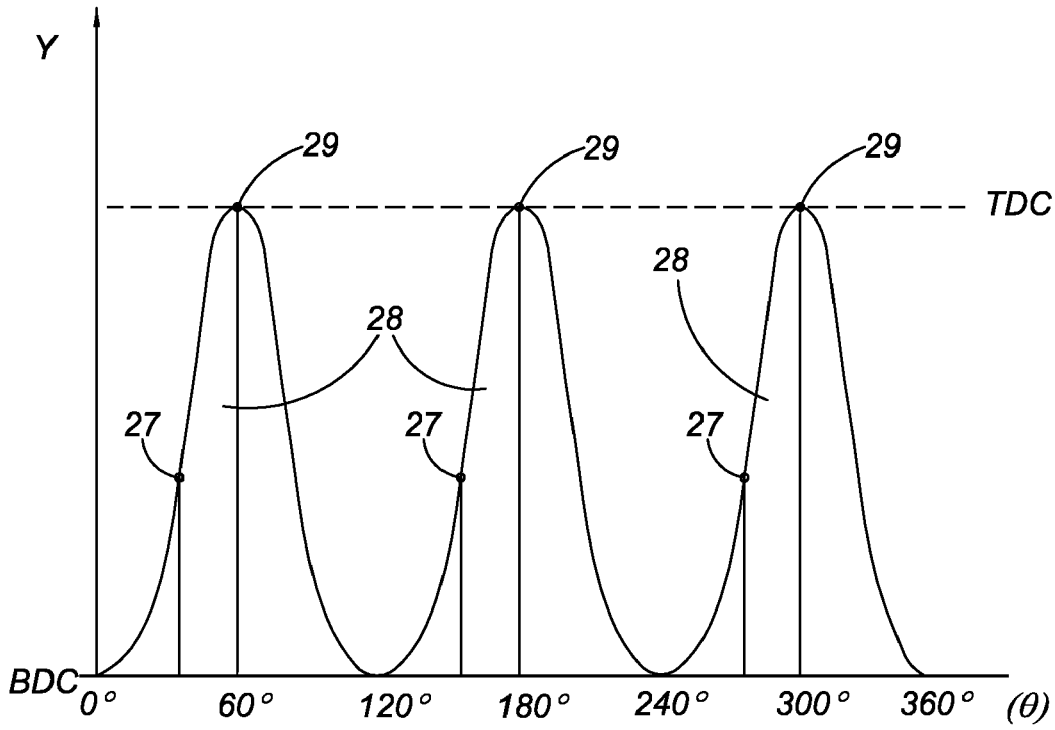
FIG. 2A is a schematic illustration describing a plunger stroke as it relates to a cam angle.
Figure 2:
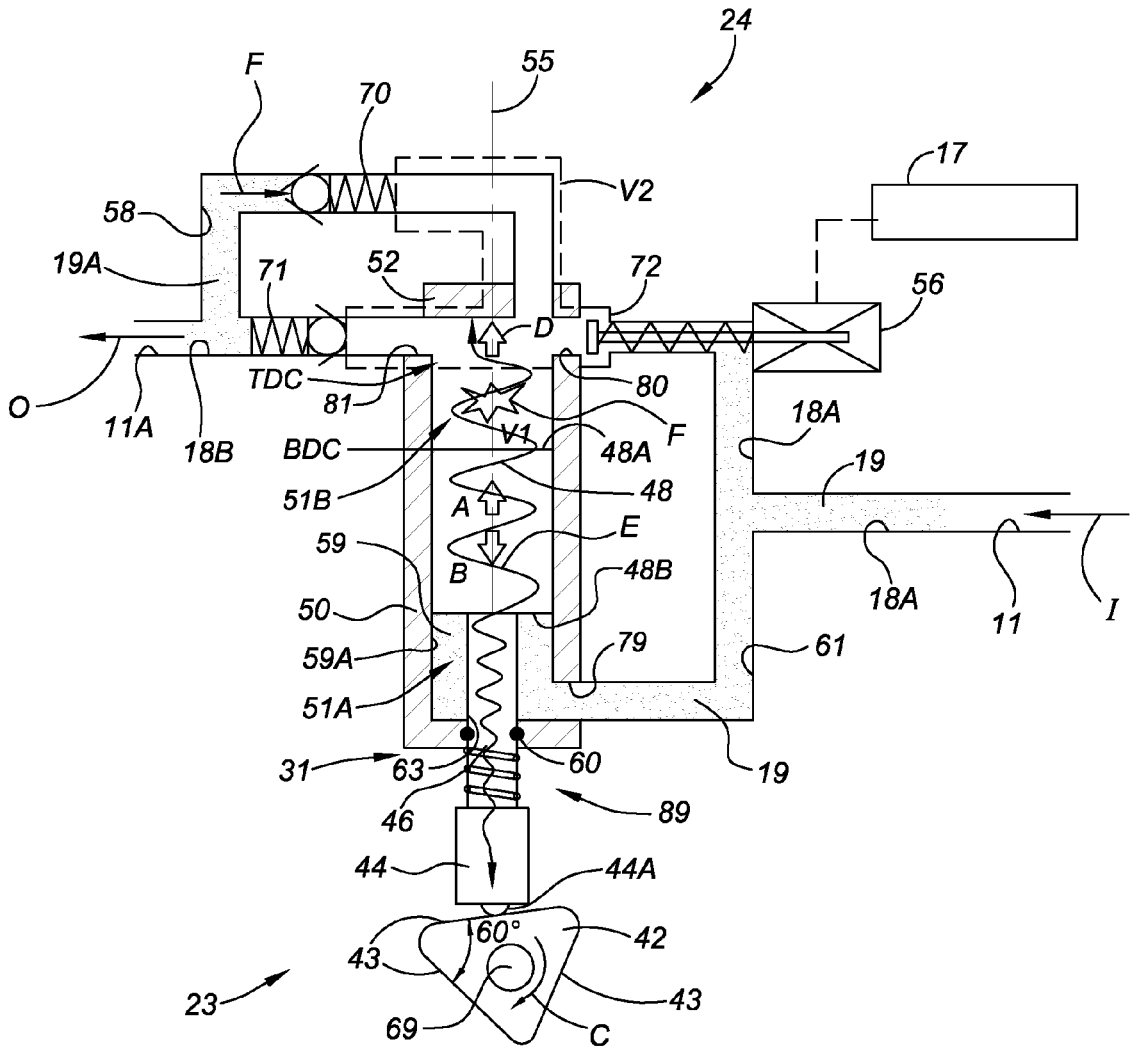
FIG. 2 is a schematic cross sectional illustration of a portion of a HP fuel pump assembly according to the invention.

Referring now to FIG. 2, the HP pump assembly 24 includes a cylinder or pump bushing 50, a piston or plunger 48, a plunger shaft 46, a cam follower piece 44, and various interconnecting fluid channels and fluid control valves, as will be described hereinbelow. The HP pump assembly 24 is shown schematically for clarity, and the various interconnected fluid channels described hereinbelow may be sized, configured, and/or routed with respect to the pump bushing 50 as needed in order to make the most efficient use of available space within the HP pump assembly 24.

The pump bushing 50 is constructed of a high-strength material, such as stainless steel or a suitable metal alloy, and defines a cylindrical cavity or pumping chamber 59 having continuous cylindrical inner wall 59A. The plunger 48 is generally cylindrically-shaped and is disposed within the pumping chamber 59, and is operable for alternately sliding or moving within the pumping chamber 59 in the directions of arrows A and B in response to a force exerted by an engine component, such as a cam portion 42 described later hereinbelow. Sealing of the plunger 48 within the pump bushing 50 relies on a high precision fit or clearance, such as but not limited to approximately 2-3 microns.

The HP pump assembly 24 is configured as a double-acting plunger as shown, and therefore, the plunger 48 separates a lower chamber 51A from an upper chamber 51B within the pumping chamber 59. The inner wall 59A of the pumping chamber 59 and a lower surface 48A of the plunger 48 substantially define the lower chamber 51A, and inner wall 59A of the pumping chamber 59 and an upper surface 48B of the plunger 48 substantially define the upper chamber 51B. A transfer port 79 leads to a lower transfer passage 61, with the lower transfer passage 61 in fluid communication with the inlet channel 18A. An amount of unused, uncompressed, or otherwise excess fuel 19 may then pass from the lower chamber 51A back toward the fuel line 11 as needed during the motion of plunger 48.

The plunger 48 may be operatively connected to or formed integrally with a plunger shaft 46, with the plunger shaft 46 positioned concentrically within and passing through an opening 63 formed in a lower portion 31 of the pump bushing 50. A seal 60, such as an o-ring or other suitable fluid seal, prevents fluid bypass through the opening 63 between the plunger shaft 46 and the pump bushing 50. The plunger 48 and the plunger shaft 46 may be integrally formed out of a single continuous piece to maximize material strength. Likewise, the relative diameters of the plunger 48 and plunger shaft 46 may be substantially equal in size, or the plunger shaft 46 may have a reduced diameter relative to the plunger 48 as shown in FIG. 2.

The HP pump assembly 24 is operatively driven via the engine 12 (see FIG. 1). To transfer power from the engine 12 to the plunger 48, therefore, a drive mechanism 23 is in continuous contact with the HP pump assembly 24, with the drive mechanism 23 configured for moving the plunger 48 in the direction of arrow A. The drive mechanism 23 may include, for example, a rotatable cam portion 42 that is configured as a lobed cam portion having substantially equal sides, each having a substantially identical surface 43. The cam portion 42 may be configured with any practical number of lobes, i.e. with 1, 2, 3, or 4 lobes being the more common lobe configurations. A three-lobe cam is shown in FIG. 2, and the remaining description hereinafter assumes such a three-lobe cam design. The cam portion 42 is operatively connected to the engine 12 (see FIG. 1) via a shaft 69 passing therethrough, with the shaft 69 directly or indirectly connected with the engine 12, thus receiving power from the engine 12 for rotating in the direction of arrow C.

Figure 3:
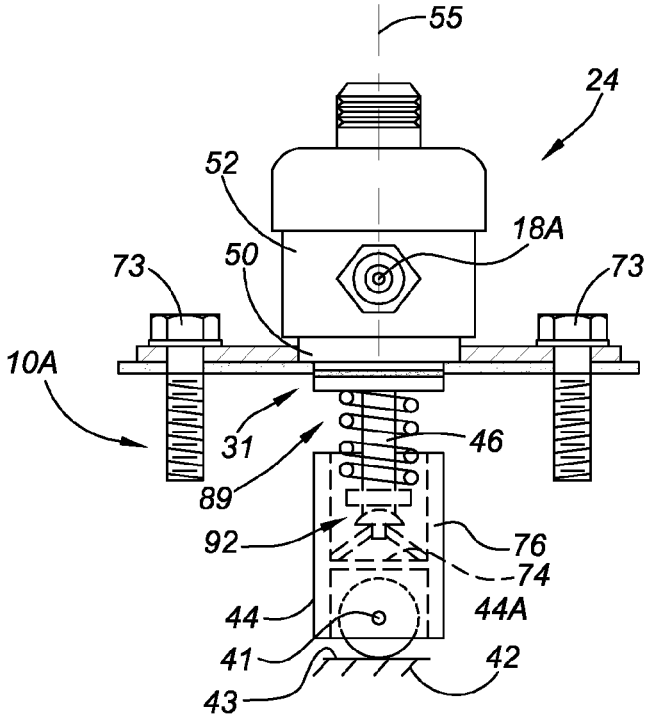
FIG. 3 is another schematic cross sectional illustration of a different portion of the HP fuel pump assembly of FIG. 2.
Figure 3A:
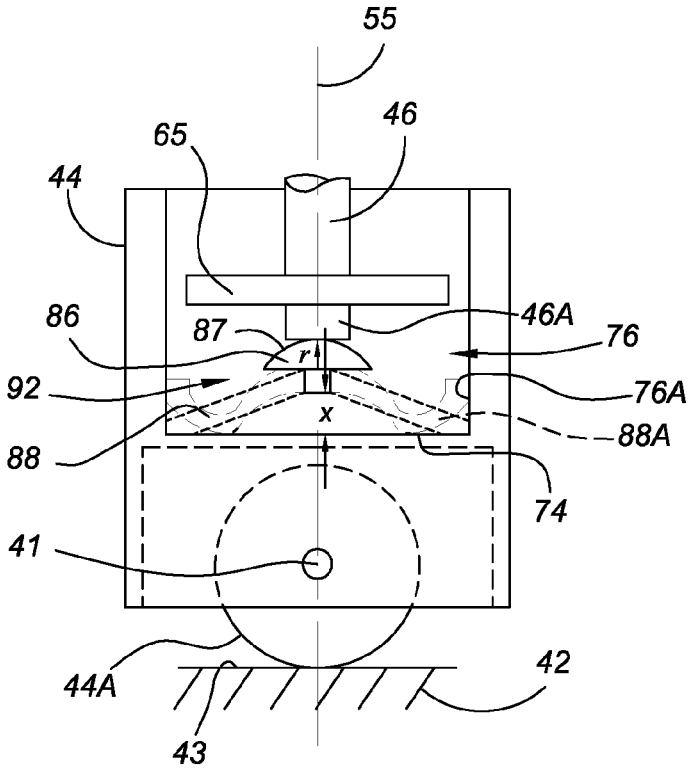
FIG. 3A is a fragmentary cross sectional illustration of a cam follower portion of the HP fuel pump assembly shown in FIGS. 2 and 3.

The plunger shaft 46, or the plunger 48 if the plunger 48 and plunger shaft 46 form a single uniform piece, is in continuous contact or engagement with a cam coupling or cam follower piece 44 (also see FIG. 3A). In one embodiment, the continuous contact between the plunger shaft 46 and the cam follower piece 44 is via an intervening mechanical isolator assembly or absorbing device 92 that is disposed between the plunger shaft 46 and a center portion 74 of the cam follower 44 piece, as will be described later hereinbelow with reference to FIGS. 3 and 3A.

The cam follower piece 44 may be constructed of a cylindrical piece of metal or other sufficiently rugged material, and is operatively connected to a wheel or roller element 44A via a connecting pin or axle 41. The roller element 44A is in continuous dynamic or rolling contact with an external surface 43 of the cam portion 42. Through rotation of the cam portion 42, the plunger 48 is first pushed or moved in the direction of arrow A to cause a pressurization phase or upstroke of the plunger 48. Thereafter, a return spring 89 positioned between the cam follower piece 44 and the lower portion 31 of the pump bushing 50 exerts a sufficient return force in the direction of arrow A to react or move the plunger 48, plunger shaft 46, and cam follower piece 44 in the direction of arrow B along their common or shared axis of motion 55. In this manner, continuous contact is maintained between the roller element 44A and cam portion 42.

Still referring to FIG. 2, the HP pump assembly 24 includes an inlet control valve 72 that is selectively actuated, such as by a solenoid 56 or other suitable control mechanism, for delivering an amount of fuel 19 from the tank 15 (see FIG. 1) through an inlet port 80 of the pump bushing 50, as represented by the arrow I. An inlet channel 18A is in fluid communication with the tank 15 (see FIG. 1) through the fuel line 11, with the fuel 19 fed to inlet valve 72 through the fuel line 11 and the lower transfer passage 61. An outlet valve 71 in fluid communication with an outlet port 81 of the pump bushing 50 is configured to actuate in response to a low differential pressure or ΔP, such as a low ΔP across the outlet valve 71. Within the scope of the invention, the actual angular orientation of the outlet valve 71 to the inlet valve 72 may vary, as such an orientation may be selected based on particular fuel line packaging requirements. Therefore, while the outlet valve 71 is shown schematically opposite the inlet control valve 72 in FIG. 2 for clarity, those of ordinary skill in the art will recognize that the outlet valve 71 need not be positioned directly opposite the inlet control valve 71. Pressurized fuel 19A is allowed to escape through an outlet channel 18B, as represented by the arrow O, and the high-pressure fuel line 11A, where it is ultimately directed to the fuel rail 16 (see FIG. 1), as described hereinabove.

A pressure relief channel 58 leads from the outlet channel 18B back to inlet valve 72, with a relief valve 70 positioned within pressure relief channel 58 as shown. The relief valve 70 is adapted to actuate in response to a sufficiently high back-pressure, represented by arrow F. In one embodiment, the back-pressure limit is approximately 210 to 230 bar, although other pressure limits may be selected in accordance with the invention. The pressure relief channel 58 thus provides a pressure return loop suitable for relieving excess pressure by returning an unusable portion of pressurized fuel 19A back to the open inlet valve 72 as needed.

As will be understood by those of ordinary skill in the art, noise in a pump assembly such as the HP pump assembly 24 may consist of a combination of hydraulic noise impulses (represented schematically by the star F), occurring within the bushing 50, as well as electro-mechanical impacts occurring within the solenoid 56. While electro-mechanical impacts may be minimized by attending to any impacting elements (not shown) within the solenoid 56, the attenuation of the hydraulic noise component within the pump bushing 50 may be a more complex endeavor due to the manner in which high pressure is rapidly generated within the pump bushing 50.

High-pressure development within the HP pump assembly 24 begins with a downward stroke of the plunger 48 in the direction of arrow B, i.e. the suction or intake stroke, whereby an amount of the fuel 19 is introduced into the pump bushing 50 from the tank 15 via the inlet valve 72. When pressure at a fuel rail 16 (see FIG. 1) drops below a desired or calibrated pressure, such as may be indicated by the pressure sensor 13 (see FIG. 1), the solenoid 56 acts to close the inlet valve 72.

The closing point of inlet valve 72 varies in relation to a required fuel pressure, and may occur anywhere during an upstroke of plunger 48, i.e. motion of plunger 48 in the direction of arrow A. At wide open throttle (WOT), which requires maximum fuel delivery and pressure, the inlet valve 72 is timed by the controller 17 to be closed by the time the plunger 48 begins its ascent from a bottom dead center position, abbreviated BDC in FIG. 2.

Referring to FIGS. 2 and 2A, for a three-lobe cam portion 42 shown in the embodiment of FIG. 2 the total maximum delivery or cam angle, represented as θ in FIG. 2A, is 60°, i.e. the point 29 at which the cam portion 42 of FIG. 2 forces or moves the plunger 48 to its top dead center position, abbreviated TDC in FIGS. 2 and 2A, with the Y axis of FIG. 2A representing the stroke of the plunger 48 along its axis 55. However, during conditions of low fuel volume and/or low pressure demand, such as during engine idle and low speed operation, the solenoid 56 does not begin to close until approximately mid-way through a stroke of the plunger 48, i.e. at an approximately 30° cam angle represented by point 27, and closing anywhere within the closing region or range represented by the region 28.

Referring again to FIG. 2, because the plunger velocity is near a maximum value when the inlet valve 72 closes, an exceedingly sharp pressure pulse (star F) is generated. For example, in less than 1 millisecond, pressure formed above the plunger 48 may rapidly increase to approximately 150 bar or higher. This pulse may be generated within the pump bushing 50, which acts as a force in the direction of arrow D. The transmitted force from the pressure pulse is reacted both equal and opposite in direction, so not only is the force of the impulse directed upward in the pump bushing 50, but also is equally transmitted as a wave downward toward the cam follower piece 44 along the axis 55, as represented by the arrow E (see FIG. 2).

Such an abrupt, almost instantaneous pressure increase is a primary source of the hydraulic noise component within the HP pump assembly 24, which propagates as a wave (see arrow E of FIG. 2) downward along the axis 55. While certain "smoothing" control algorithms may be programmed into or otherwise stored in the controller 17 to coordinate the pressure rise inside of the pump bushing 50 with the velocity of the plunger 48, in some instances, such as during cold starts, such control algorithms may have a less than optimal effect on absorbing the hydraulic noise component.

For optimal reduction of a hydraulic noise component in HP pump assembly 24, therefore, the invention is directed toward achieving an increase in compliance of the HP pump assembly 24, with the term "compliance" referring herein to the reciprocal of hydraulic stiffness, as will be understood by those of ordinary skill in the art. Within the scope of the invention there are two primary methods by which to introduce or increase compliance within the HP pump assembly 24, with both methods acting to reduce, dissipate, or otherwise absorb the hydraulic noise component discussed above: (1) by affecting the volume and shape of a "slug" of fuel trapped above the plunger 48 in the upper chamber 51B, i.e. by hydraulic compliance means, and (2) by increasing the mechanical compliance of the plunger 48 and the plunger shaft 46 along the axis 55 using a mechanical compliance means. Therefore, in accordance with the invention one or more compliance devices, whether hydraulic or mechanical as described below, may be selected for providing a particular level of hydraulic and/or mechanical compliance to achieve the optimal balance, and therefore at least one such compliance device is provided within the HP pump assembly 24, as will now be described with reference to FIGS. 3 through 5C.

The stiffness of such a slug or column of pressurized fuel 19A may be represented by the equation:

$$K=[A^2B]/V$$

wherein A=the cross sectional surface area of the plunger 48, V=the total volume of the trapped slug, and B=the bulk modulus of the involved fluid, i.e. the fuel 19. For gasoline, B=1, 035 MPa. In FIG. 2, the total volume "V" may determined by adding the displaced volume V1 within the pump bushing 50 and the dead volume V2, i.e. the volume remaining in the pump bushing 50 when the plunger 48 is at top dead center (TDC).

Referring to FIG. 3, the HP pump assembly 24 has an axis 55 and a pump bushing 50, as described hereinabove with reference to FIG. 2. The pump bushing 50 has an upper portion 52 and a lower portion 31. Mounting bolts 73 or other suitable fasteners connect the HP pump assembly 24 to a vehicle surface 10A of the vehicle 10 (see FIG. 1), such as a bushing head, engine block, or other suitable surface. The HP pump assembly 24 includes the plunger 48 (see FIG. 2), which is hidden from view in FIG. 3, which is operatively connected to or formed integrally with the plunger shaft 46. A first compliance device 92 is positioned within the cam follower piece 44 between a spring retainer 65 (see FIG. 3A) and a center portion 74 of a cavity 76 formed within the cam follower piece 44, as will now be discussed with reference to FIG. 3A.

Referring to FIG. 3A, the first compliance device 92 is shown as a spring isolator assembly that is positioned within the cavity 76 of cam follower piece 44. The first compliance device 92 consists of a contact button 86 having an upper surface 87 forming a radius r. The upper surface 87 is in contact with an end, tip, or shaft portion 46A of the plunger shaft 46, i.e. a portion of the plunger shaft 46 passing or protruding through the spring retainer 65.

To provide sufficient mechanical compliance along the axis 55, a spring device 88 is positioned within the cavity 76 of the cam follower piece 44. The spring device 88 may be any device having a predetermined spring force, for example a compressible or deflectable spring washer as shown, such as a Belleville washer, or alternately a press-fit spring device 88A as shown in phantom, with the press-fit spring device 88A being a cup-shaped device configured and/or sized to press-fit against an inner wall 76A of the cavity 76 to optimize retention of spring device 88A within the cavity 76. The stiffness of the spring device 88, 88A may be selected to provide a desired overall level of mechanical compliance.

The button 86 is used to bridge the distance between the shaft portion 46A and the spring device 88, as well as compensating for minor misalignment of the HP pump assembly 24 (see FIGS. 2 and 3). For example, unequal tightening of mounting bolts 73 (see FIG. 3) may cause a binding condition of the plunger 48 (see FIG. 2) within the pump bushing 50. The radius (r), i.e. the convex upper surface 87 of the button 86, is thereby intended to accommodate a greater degree of such misalignment.

Additionally, the stiffness of spring device 88, 88A, as well as the clearance "x" between the button 86 and the center portion 74 of the cavity 76, may be selected and/or configured to limit deflection and provide optimal noise reduction within a predetermined pressure range. When operating at low pressures, for example, in one embodiment the spring device 88, 88A may be configured with a stiffness of approximately 2400 to 2700 N/mm and a deflection of approximately 0.3 to 0.4 mm, although other stiffness ranges and/or deflection distances may be usable within the scope of the invention.

To provide sufficient hydraulic compliance, the pump bushing 50 is also adapted in a particular manner in accordance with the invention, as will now be described with reference to FIGS. 4A-4B. Volumetric efficiency of a pump is inversely proportional to a stiffness measured along an axis of the pump's plunger, for example along the axis 55 of the HP pump assembly 24 of FIGS. 2, 3, and 3A. A percentage change in volumetric efficiency, or ΔVE(%), may therefore be expressed in equation form as:

$$\Delta VE(\%)=(A^2\cdot B)/V_{displ}\cdot[(K_x-K_{ref})/(K_x\cdot K_{ref})]$$

wherein A=cross sectional surface area of plunger 48, B=the bulk modulus of the involved fluid, i.e. the fuel 19, $V_{displ}$=displaced volume, i.e. V1 of FIG. 2, $K_x$=combined hydraulic and mechanical stiffness of condition "x", and $K_{ref}$=combined reference stiffness or a baseline stiffness. The above equation demonstrates a performance tradeoff effect resulting from decreasing the hydraulic stiffness of a given pump assembly, i.e. increasing its compliance, as such a reduction in stiffness reduces the efficiency of the pump assembly. Therefore, as noted hereinabove, deflection of spring portion 88, 88A may be limited to a predetermined range or value sufficient for providing noise reduction only within a particular range of pressures, such as within a band of relatively low operating pressures wherein such noise reduction may be most desirable, and may be configured to "bottom out" at the center portion 74 to essentially form a rigid, continuous connection between plunger shaft 46 and cam follower 44.

Figure 4A:
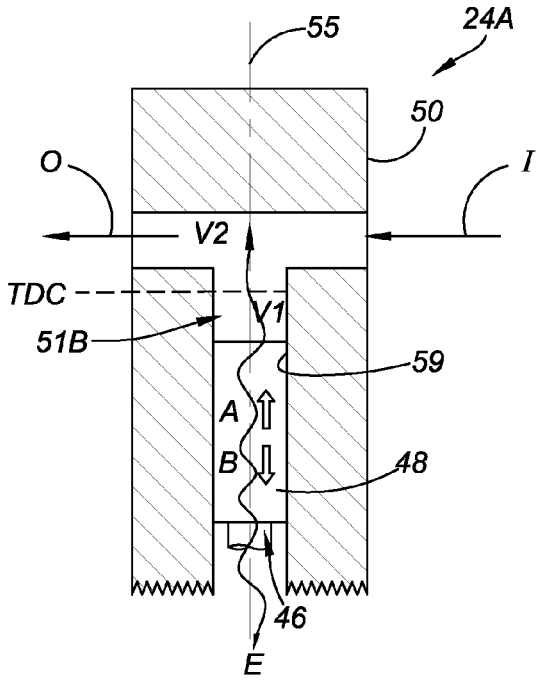
FIG. 4A is a schematic fragmentary cross sectional illustration of a representative bushing portion of an HP fuel pump assembly.

Referring to FIG. 4A, a portion of a HP pump assembly 24A is shown in simplified schematic cross sectional view for clarity, with the HP pump assembly 24A configured as per HP pump assembly 24 in FIGS. 2 and 3. FIGS. 4B through 4D in turn describe various alternate embodiments the HP pump assembly 24, and are labeled as the HP pump assemblies 24B, 24C, and 24D, respectively.

Beginning with FIG. 4A, the HP pump assembly 24A, which is a portion of the HP pump assembly 24 shown at FIGS. 2 and 3, includes the pump bushing 50 and the plunger 48 disposed therein, with the plunger 48 operable for moving in the directions of arrows A and B as described previously hereinabove. A hydraulic noise component or wave (arrow E) propagates along axis 55 in response to a pressure pulse. While not shown in FIGS. 4A through 4D, this hydraulic noise component (arrow E) could be mechanically absorbed or dissipated along axis 55 using the isolator assembly 92 described hereinabove and shown in FIGS. 3 and 3A. However, a baseline amount of hydraulic compliance is also provided via displaced volume V1 and any existing dead volume V2, as described with reference to FIG. 2.

Figure 4B:
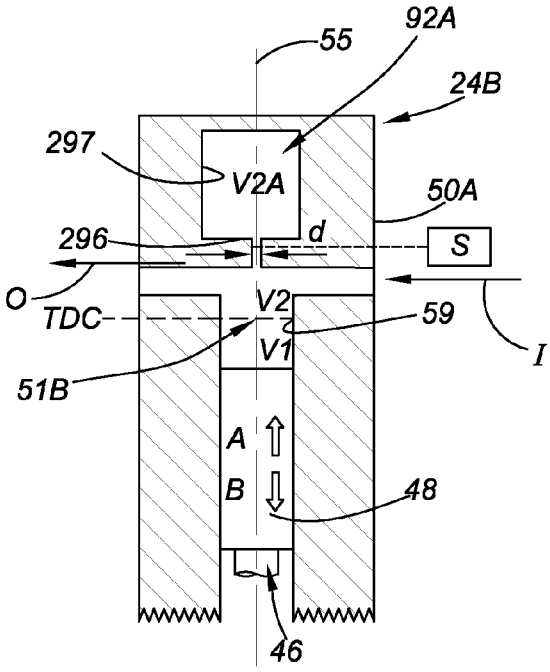
FIG. 4B is a schematic fragmentary cross sectional illustration of an alternate bushing portion of the HP fuel pump assembly of FIGS. 2 and 3, the bushing portion having two interconnected volumes forming an accumulator.
Figure 4C:
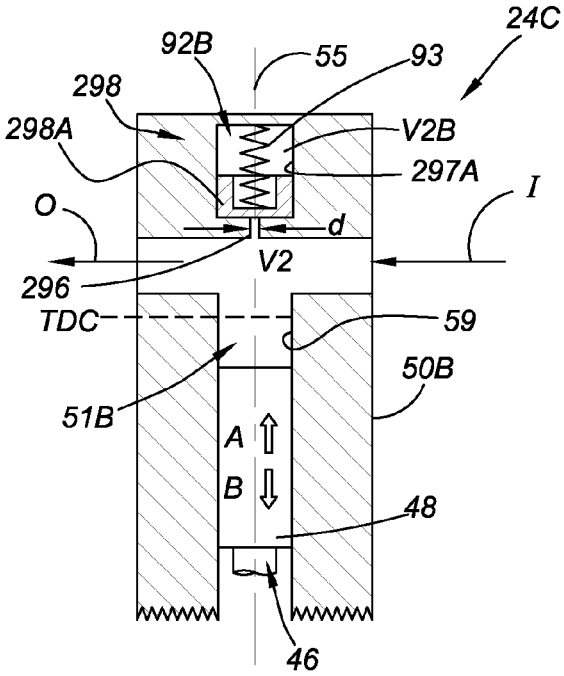
FIG. 4C is a schematic fragmentary cross sectional illustration of an alternate bushing portion of the HP fuel pump assembly of FIGS. 2 and 3 having a piston accumulator disposed in one of two interconnected volumes.
Figure 4D:
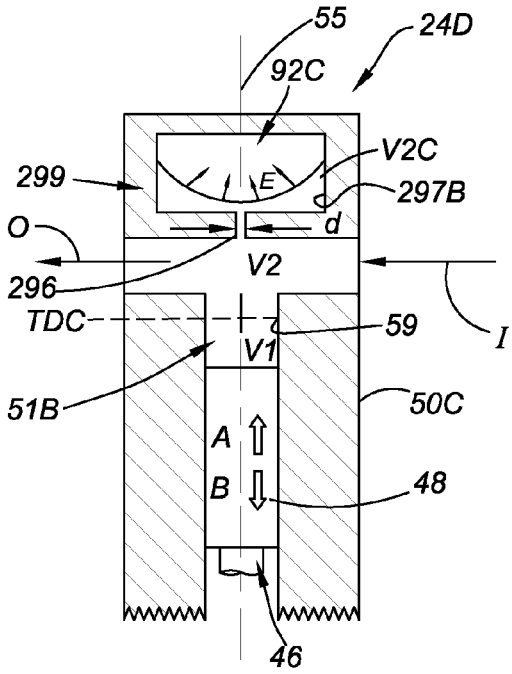
FIG. 4D is a schematic fragmentary cross sectional illustration of an alternate bushing portion of the HP fuel pump assembly of FIGS. 2 and 3 having a disc absorber disposed in one of two interconnected volumes.

Referring to FIG. 4B, an alternate HP pump assembly 24B has a control orifice 296 having a diameter "d" is positioned between upper chamber 51B and a second compliance device 92A, such as a cavity or volume V2A defined by a plurality of side walls 297 formed in the bushing 50 opposite upper chamber 51B. As shown in FIG. 4B, the diameter d of the control orifice 296 may be selectively controlled using a solenoid device (S), if desired, or configured as a fixed diameter d. The dead volume V2 is effectively increased, thus increasing a volume of a slug of pressurized fuel 19A (not shown) trapped therein.

Diameter d of the control orifice 296, and the volume V2A, are each selected to provide sufficient hydraulic compliance within a predetermined pressure range, with the control orifice 296 sized so as to have a negligible effect on compliance above a selected threshold. In other words, at low speeds of the plunger 48, the combined volume V1+V2, and the volume V2A, will effectively "communicate" across the control orifice 296, which may be selectively opened using solenoid S or simply configured with an appropriately sized diameter d, to yield an increased level or amount of hydraulic compliance. This is achieved by lowering the stiffness of the slug of pressurized fuel 19A (not shown), while at higher speeds the fixed time constant of the control orifice 296 would in essence decouple the volume V2A. Thereafter, hydraulic stiffness would increase, resulting in better pumping efficiency. In this manner, sufficient low pressure reduction of a hydraulic noise component may be achieved by smoothing pressure pulsations within bushing 50A without also compromising efficiency of the HP pump assembly having portion 24B during higher pressure operation.

Referring to FIG. 4C, an alternate HP pump assembly 24C has an alternate bushing 50B. In the embodiment of FIG. 4C, the control orifice 296 described above is positioned between the upper chamber 51B and a cavity or volume V2B defined by a plurality of side walls 297A. Although not shown in FIG. 4C, a solenoid S (see FIG. 4B) may also be provided for controlling the diameter d of the control orifice 296, as described above with reference to FIG. 4B. A third compliance device 92B includes a deflectable or otherwise at least partially moveable mechanism, i.e. a mechanical device that deflects or moves in one direction in response to an applied force. For example, a piston accumulator device 298 having an accumulator piston 298A and a return spring 93 as shown in FIG. 4C may be disposed within the volume V2A. In this alternate embodiment, an extra control variable is introduced by the presence of the return spring 93, the qualities of which may be selected to have an optimal spring force through the desired pressure range.

Finally, referring to FIG. 4D, another alternate HP pump assembly 24D has a control orifice 296 that is positioned between the upper chamber 51B and a volume V2C defined by a plurality of side walls 297B, similar to the embodiments shown in FIGS. 4B and 4C. Although not shown in FIG. 4D, a solenoid S (see FIG. 4B) may also control the diameter d of the control orifice 296, as described above with reference to FIG. 4B. A fourth compliance device 92C has another deflectable mechanism, such as a thin disc absorber device 299 having a deflection force represented by arrows E, is disposed within the volume V2B. In this alternate embodiment, the thin disc absorber device 299 may be selected to have an optimal deflection force (arrows E) through the desired pressure range.

Figure 5A:
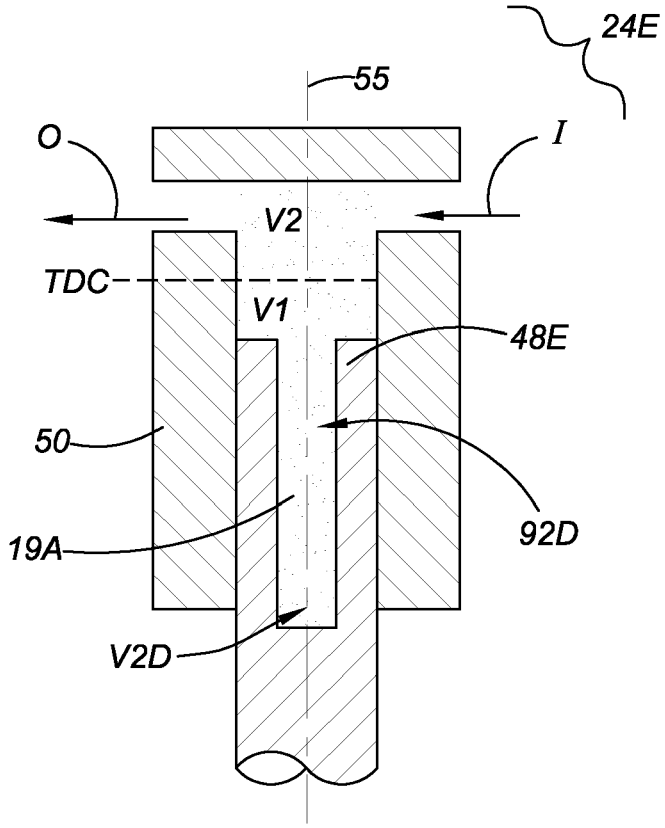
FIG. 5A is a schematic fragmentary cross sectional illustration of a plunger having an increased hydraulic compliance.
Figure 5B:
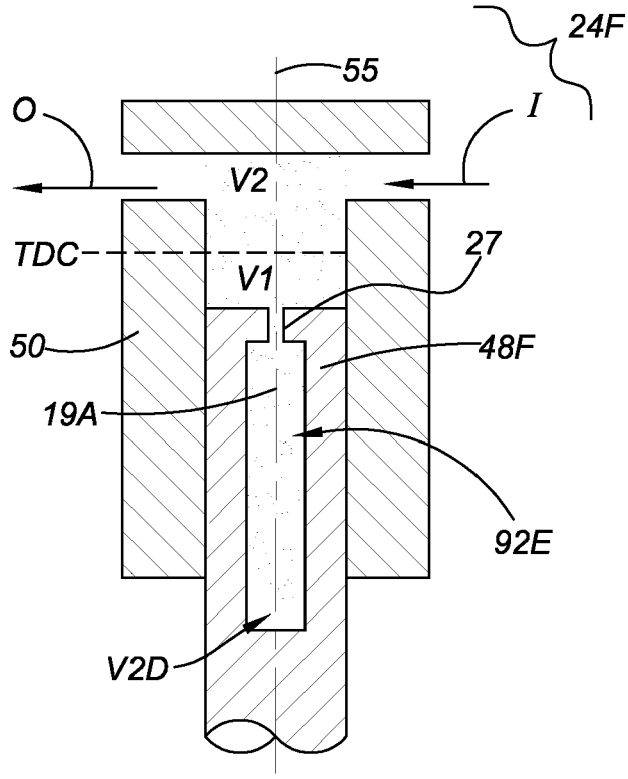
FIG. 5B is a schematic fragmentary cross sectional illustration of an alternate embodiment to the plunger of FIG. 5A.
Figure 5C:
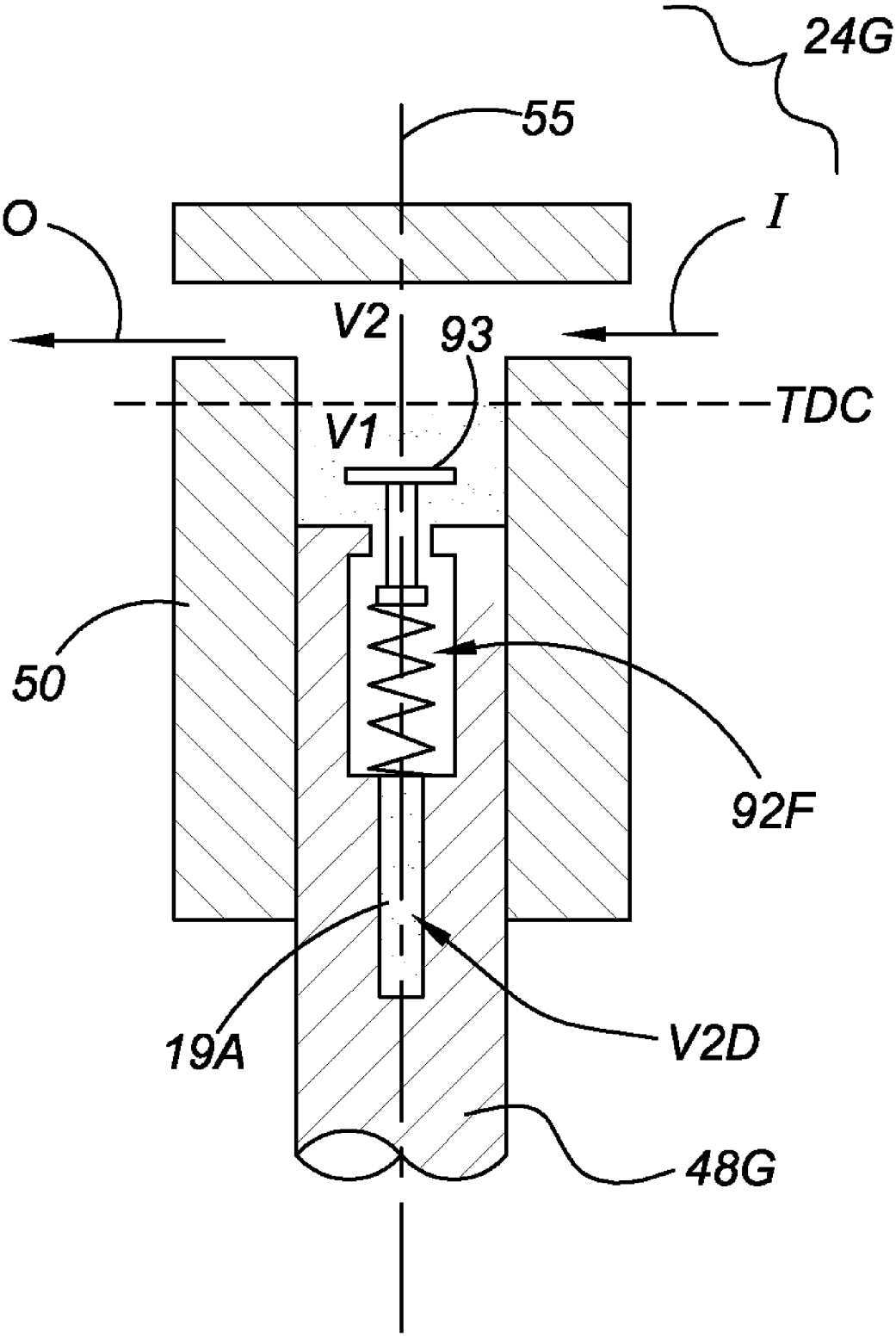
FIG. 5C is a schematic fragmentary cross sectional illustration of another alternate embodiment to the plungers of FIGS. 5A and 5C.

Referring now to FIGS. 5A through 5C, respective alternate embodiments of a HP pump assembly 24E, 24F, and 24G each have a respective plunger 48E, 48F, 48G configured to increase hydraulic compliance by effectively increasing the volume of a trapped slug of pressurized fuel 19A using a specially configured plunger 48 as described hereinbelow. In FIG. 5A, a portion of a HP pump assembly 24E has an alternate plunger 48E that is configured with a fifth compliance device 92D having an internal volume V2D, for example by boring or hollowing the plunger 48E along axis 55. The internal volume V2D increases the total volume of a trapped slug of pressurized fuel 19A, previously restricted to the dead volume V2 remaining within the pump bushing 50 at the top of stroke, i.e. top dead center (TDC), of plunger 48E, with a resultant reduction in stiffness as explained previously hereinabove.

Referring to FIG. 5B, a HP pump assembly 24F has an alternate plunger 48F including a sixth compliance device 92E having an internal volume V2D and a control orifice 27. During low speeds of the plunger 48F, i.e. low speeds of engine 12 (see FIG. 1), the volumes V1 and V2 effectively communicate with volume V2D via the control orifice 27 to yield a higher level of hydraulic compliance. As the speed of plunger 48F increases, this effect is effectively eliminated due to the fixed time constant of control orifice 27, which acts to decouple volume V2D from the volumes V1 and V2, thus allowing pump efficiency to increase at high engine speeds.

Finally, as shown in FIG. 5C, a HP pump assembly 24G has an alternate plunger 48G has a seventh compliance device 92F, including a valve 93 configured with a spring 93A having a predetermined spring force. The spring 93A is positioned between the volumes V1 and volume V2D. In the embodiment shown in FIG. 5C, the valve 93 is configured as a poppet valve calibrated for a desired "switching" pressure to thereby enable a 2-step system volume, i.e. volumes V1 and V2 and the combined volumes V1, V2, and V2D, depending on the position of the valve 93. In this manner, the internal volume V2D is made selectively available under low engine speed conditions to thereby increase hydraulic compliance, with the valve 93 closing to seal off volume V2D when engine speeds increase above a threshold speed.

While the best modes for carrying out the invention have been described in detail, those familiar with the art to which this invention relates will recognize various alternative designs and embodiments for practicing the invention within the scope of the appended claims.

The invention claimed is:

1. A fuel pump assembly for pressurizing an amount of fuel, the pump assembly comprising:

a pump bushing defining a pumping chamber;

a plunger disposed within the pumping chamber, and that is moveable within the pumping chamber for pressurizing the amount of fuel, the plunger having a primary axis of motion;

a cam follower piece in continuous contact with the plunger and moveable therewith along the primary axis in response to motion of an engine component; and at least one compliance device configured for absorbing a hydraulic noise component along the primary axis;

wherein the at least one compliance device includes a cavity adapted for use as a hydraulic accumulator for increasing a dead volume within at least one of the pump bushing and the plunger, the cavity being in fluid communication with the pumping chamber via a control orifice.

2. The fuel pump assembly of claim 1, wherein the at least one compliance device includes a spring for providing a predetermined spring force along the primary axis of motion.

3. The fuel pump assembly of claim 2, wherein the spring is selected from the group consisting of a spring washer and a press-fit spring device.

4. The fuel pump assembly of claim 1, further comprising a solenoid device configured for selectively varying a diameter of the control orifice.

5. The fuel pump assembly of claim 1, further comprising a moveable mechanism that is positioned within the cavity, the moveable mechanism being operable for moving in one direction to thereby increase a volume of the cavity, and in another direction to thereby decrease the volume of the cavity.

6. The fuel pump assembly of claim 5, wherein the cavity is positioned within the pump bushing, and wherein the moveable mechanism is selected from the group consisting of a piston accumulator device and a thin disc absorber device.

7. The fuel pump assembly of claim 5, wherein the cavity is positioned within the plunger, and wherein the moveable mechanism includes a valve operable for selectively admitting a portion of the amount of fluid into the cavity in response to a predetermined condition.

8. The fuel pump assembly of claim 7, wherein the valve is a poppet valve having a calibrated switching pressure, and wherein the predetermined condition is a threshold engine speed corresponding to the calibrated switching pressure.

9. A high-pressure fuel pump assembly comprising:

a pump bushing defining a pumping chamber;

a plunger that is moveable within the pumping chamber for pressurizing an amount of fuel, the plunger and the pump bushing sharing a common axis;

a cam follower piece having a cavity formed in one end, the cam follower piece being adapted for continuous dynamic contact at another end with a moveable engine component;

wherein the cam follower piece includes a first compliance device that is configured for absorbing a hydraulic noise component along the common axis, and wherein the first compliance device is one of a spring washer and a press-fit spring device providing a predetermined spring force along the common axis of motion for achieving the absorbing of the hydraulic noise component.

10. The high-pressure fuel pump assembly of claim 9, wherein at least one of the pump bushing and the plunger includes a cavity adapted as a second compliance device which acts as a hydraulic accumulator for increasing a dead volume within the pump bushing, and wherein the cavity is in fluid communication with the pumping chamber via a control orifice.

11. The high-pressure fuel pump assembly of claim 10, wherein the cavity is positioned within the pump bushing and encloses a moveable mechanism selected from the group consisting of a piston accumulator device and a thin disc absorber device.

12. The high-pressure fuel pump assembly of claim 10, further comprising a solenoid device operable for selectively varying a diameter of the control orifice.

13. A vehicle comprising:

an internal combustion engine;

a transmission operatively connected to the internal combustion engine for propelling the vehicle;

a fuel rail having at least one fuel injector device configured for injecting an amount of pressurized fuel into the internal combustion engine for combustion therein; and a fuel pump assembly for delivering the amount of pressurized fuel to the fuel rail, the fuel pump assembly having a pump bushing defining a pumping chamber and a plunger that is moveable within the pumping chamber for pressurizing an amount of fuel to produce the amount of pressurized fuel;

wherein the fuel pump assembly is configured with at least one compliance device configured for absorbing a hydraulic noise component within the fuel pump assembly, wherein the at least one compliance device includes a cavity adapted for use as a hydraulic accumulator for increasing a dead volume within at least one of the pump bushing and the plunger, the cavity being in fluid communication with the pumping chamber via a control orifice.

14. The vehicle of claim 13, wherein the at least one compliance device includes a spring positioned for absorbing the hydraulic noise component along an axis shared by the pumping chamber and the plunger.

15. The vehicle of claim 13, further comprising a moveable mechanism positioned within the hydraulic accumulator cavity, the moveable mechanism being selectively moveable for alternately increasing and decreasing an available portion of a volume of the cavity.

* * * * *